United States Patent [19]

McGeer

[11] Patent Number: 4,460,440

[45] Date of Patent: Jul. 17, 1984

[54] ELECTROLYTIC PRODUCTION OF ALUMINUM AND CELL THEREFOR

[75] Inventor: James P. McGeer, Kingston, Canada

[73] Assignee: Alcan International Limited, Montreal, Canada

[21] Appl. No.: 499,916

[22] Filed: Jun. 1, 1983

[30] Foreign Application Priority Data

Jun. 18, 1982 [GB] United Kingdom ..... 8217711

[51] Int. Cl.[3] ..... C25C 3/06; C25C 3/08

[52] U.S. Cl. ..... 204/67; 204/245

[58] Field of Search ..... 204/67, 245

[56] References Cited

U.S. PATENT DOCUMENTS 4,308,115 12/1981 Foster et al. ..... 204/67

4,392,925 7/1983 Alder et al. ..... 204/245

*Primary Examiner*—Howard S. Williams

*Attorney, Agent, or Firm*—Cooper, Dunham, Clark, Griffin & Moran

[57] ABSTRACT

In an electrolytic reduction cell for aluminium production, the cathode is constituted by an array of upwardly open tubular elements (5) filled with molten metal and extending upwards from the molten metal pool (8) into the molten electrolyte (9). The metal within each tube is in open communication with the molten metal in the pool. The elements are of a material such as titanium diboride which is wetted by molten aluminium but not by molten electrolyte. The vertical tubes in the elements have an internal diameter, preferably of 0.5–2.5 cms, chosen so that the molten metal level therein is maintained at or close to the top of the tube by capillary action. Preferably the tubular elements extend about 1–4 cms up into the molten electrolyte layer and are positioned at a center-to-center spacing of 1.2 to 3 times their external diameter.

14 Claims, 3 Drawing Figures

ELECTROLYTIC PRODUCTION OF ALUMINUM AND CELL THEREFOR

Figure 1:
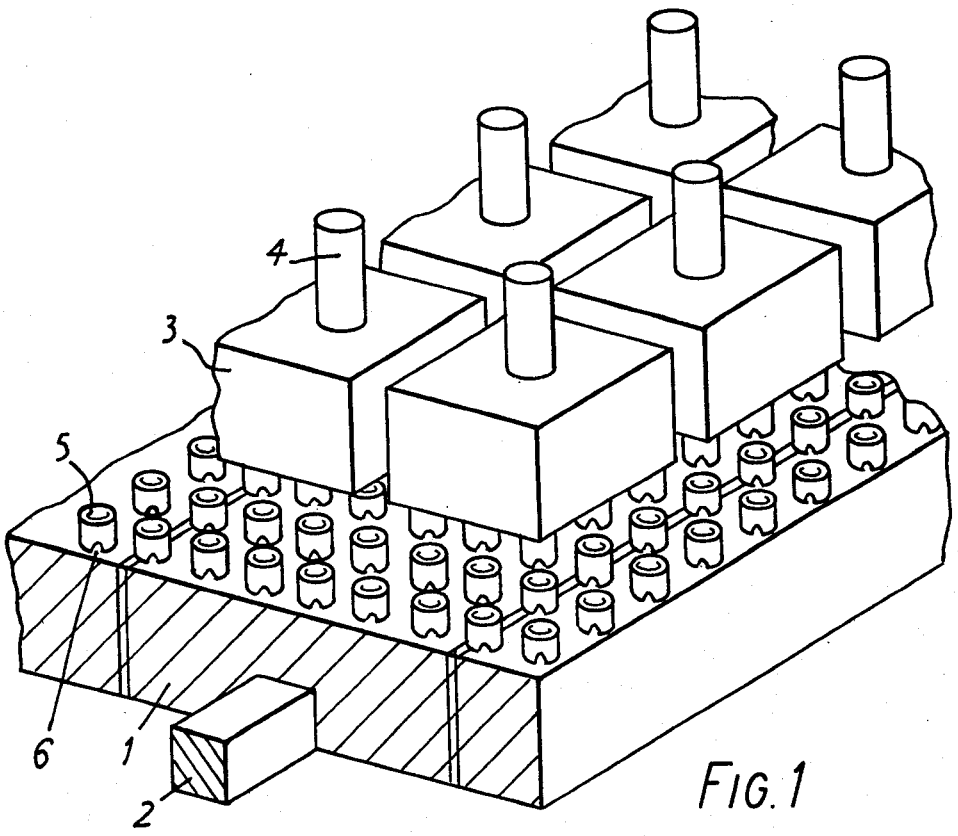

The present invention relates to electrolytic reduction cells for the production of aluminium, in which the metal is produced in molten form by electrolysis of molten electrolyte which is less dense than molten aluminium, by passage of current between overhead anodes and a cathodic cell floor structure, the electrolyte being contained in a refractory-lined shell structure.

In such reduction cells it is desirable to maintain the anode/cathode distance at the lowest practicable value to hold down the energy losses involved in overcoming the resistance of the electrolyte. In a conventional reduction cell, in which the cathode is constituted by a pool of molten aluminium, the wave motions induced by the magnetohydrodynamic forces acting on the molten metal, makes it generally impracticable to operate with an anode/cathode distance of less than about 5 cms. It has, however, long been recognized that the use of a so-called drained cathode structure would permit the use of a much smaller anode/cathode distance, since in such cells the product metal is continuously drained away to a sump, leaving no more than a thin film of molten metal on the active cathode surface of the cell floor.

Although many proposals have been put forward for drained cathode cells, no arrangement has so far been found cost effective in terms of prolonged satisfactory operation in relation to the necessarily high capital cost (as compared with a conventional cell equipped with a carbon-lined cathodic floor, supporting a conventional liquid metal cathode).

In drained cathode constructions the active cathode is constituted by electroconductive material, which is resistant to attack both by molten aluminium and the molten fluoride cell electrolyte. This stringent materials requirement has led in practice to the employment of "hard metal" refractories, which are constituted by carbides, borides, silicides and nitrides of transition metals. For the purpose of constructing drained cathodes borides are the preferred material, particularly $TiB_2$, which is both electrically conductive, highly resistant to attack by both molten aluminium and molten fluoride electrolyte. It is also wetted by molten aluminium, but not wetted by molten fluoride electrolyte.

It has already been proposed in U.S. Pat. No. 4,071,420 to construct an electrolytic cell with a plurality of upwardly facing spaced tubes, containing molten aluminium, to act as the active cathode of a reduction cell. These aluminium-filled tubes project upwardly into the cell electrolyte from within a pool of molten metal in the bottom of the cell. This pool of molten metal is restricted in its lateral dimensions and in consequence the magnetohydrodynamic disturbances are also limited in amplitude. In the aforesaid United States Patent the bottom ends of the aluminium-containing tubes are sealed into the cell floor and the produced molten metal overflows the top ends of the tubes to flow down their outer surfaces. An arrangement of that type is open to the objection that connection to the cathode floor is required to maintain the tubes at their datum position, but owing to the difference in materials employed with different expansion characteristics and different resistance to chemical attack and thermal stress, it is improbable that the tubes could be maintained intact and at their datum position for prolonged periods.

Another problem to be faced in the operation of a commercial electrolytic cell for production of aluminium is the formation of sludge, consisting of relatively large lumps of alumina, with a surface coating of cell electrolyte. Such sludge is the result of feeding alumina to the cell by conventional cell-crust breaking and tends to accumulate in the bottom of the cell. In conventional cells, where there is substantial circulatory movement of the molten metal, such sludge is kept in balance it is believed by upward transport around the edges of the molten metal at the boundary of the frozen electrolyte at the side walls of the cell.

Where the upper ends of the cathode tubes are open and the bottom ends of such tubes are closed, some possibility exists that such tubes will become progressively filled with sludge with consequent slow disturbance of the electrical characteristics of the cell.

In a cell constructed in accordance with the present invention the cathode remains in the form of an array of upwardly open tubular elements, but a different principle of operation is employed. The molten metal within the tube is in open communication with the molten metal in the metal pool in the bottom of the cell. In this case the diameter of the tube is chosen so that the level of molten metal may be maintained at or close to the upper end of the tube by capillary action at all molten metal levels occurring in the normal operating cycle of the cell. The availability of capillary action for this purpose is dependent upon the tubes being wettable by molten metal, but non-wettable by the cell electrolyte.

The tubular elements for the present purpose may be free-standing elements supported on the cell floor, having one or more lateral passages communicating with the molten metal pool. In the event of sludge-forming particles entering the capillary passage of a tubular element it will be able to pass out through the lateral gallery. However the entry of such particles into the capillary passage is highly unlikely, since it will be strongly resisted by surface forces at the metal/electrolyte interface at or within the capillary passage. The individual elements may have a tripod foot, with lateral slots or galleries between the feet. Such galleries or slots are however dimensioned so as to remain wholly filled by molten metal at minimum metal level; i.e. the metal level at the end of siphon tapping of the cell. Each element may be provided with one or more vertical capillary passages, each open at its lower end. Where free-standing tubular elements are employed the cathode current is conducted through the molten metal pool in the cell floor either to current collectors beneath the floor (which in such circumstances must be electrically conductive) or to current collectors in the floor or in the cell side walls in direct contact with the molten metal. There may be a monolayer of refractory hard metal elements submerged in the molten metal. Such elements require to be resistant to attack by molten metal and most conveniently are resistant to attack by molten electrolyte. It is immaterial whether such elements are electrically conductive or non-conductive. However they are preferably formed of $TiB_2$ composites because of the high resistance of $TiB_2$ to chemical attack. The purpose of such a layer is twofold.

1. To provide a continuous metal surface on the bottom of the cell when the depth of the metal pool is small.

2. To prevent movement of the free-standing tubular elements.

In the construction of a cell furnished with capillary tube cathode elements in accordance with the present invention it is preferred that all cell surfaces exposed to molten aluminium and/or to molten cell electrolyte should be free from carbon or carbon-bearing materials to reduce the possibility of deposition of aluminium carbide on or in the capillary tube elements, since such deposition tends to reduce the wettability of such elements by molten metal and thus decreases the capillary effect of the passages in such elements. Such carbon-free surfaces may be formed from electrically-conductive material, such as $TiB_2$ or from electrically and thermally insulating material, such as alumina or other oxide- or nitride-based refractories. However for reasons of capital cost in some instances the cell may be carbon-lined in the conventional manner.

A cell in accordance with the invention is preferably arranged so that the metal produced between successive tappings collects in the space around the tubular elements and thus the provision of a large metal collection sump, which would be a point of weakness in the cell lining is avoided. The length of the tubular elements is selected such that the molten metal level around the elements is below the top of the elements, preferably at least 1 cm. below the top of the elements before tapping, while the cross galleries remain submerged by molten metal after tapping. Thus in most instances the length of the tubular stem above the cross galleries is about 5 cms. to alow for a 3 cm. increase in metal pool depth between tapping operations.

In operation the change in level of the cell electrolyte is evened out as far as possible by use of a displacement block or individually adjustable anodes as described in our co-pending British Patent Application No. 8217712 filed June 18, 1982.

It will be appreciated from the above that the internal diameter of the capillary passage must be chosen such that the capillary action will support a column of not less than about 4 cms. of molten aluminium metal within the molten cell electrolyte. The corresponding maximum diameter of the capillary passage is, inter alia, dependent upon the difference in density between molten aluminium and the cell electrolyte, which may vary to some extent according to its composition. Calculation from available information indicates that with a conventional fluoride cell electrolyte surface forces will maintain an aluminium column of 4 cms. in a $TiB_2$ tube having an internal diameter up to 3.3 cms. We prefer to limit the internal diameter of the capillary passage to the range of 0.5–2.5 cm. To provide adequate mechanical strength for the tubular elements without occupying excessive space we prefer to employ a wall thickness in the range of 2–6 mm. for the capillary tube passages while the inter element centre-to-centre spacing (in an equilateral triangular spacing) is 1.2–3 times the external diameter of the capillary tube portion of the cathode elements. When the spacing is less than that indicated the metal storage space between the elements is somewhat excessively reduced with correspondingly great variation in maximum and minimum metal levels, whereas with greater than the maximum indicated spacing the current density at the upper ends of the cathode elements becomes somewhat undesirably high.

Although the above refers exclusively to upright cylindrical tubes having constant wall thickness other shapes are possible. For example the tube can be tapered both internally and externally to provide a more stable base. Oval square or rectangular section elements are also possible and may be preferred in some applications.

The lower ends of the tubular elements may be loosely fitted into shallow recesses in the cell floor to restrict lateral movement due to transverse flow of the metal surrounding the elements.

The gap between a free standing tubular element and the wall of its recess is preferably sized so as to avoid or restrict entry of slag particles. As will readily be understood this may be achieved by taking advantage of interfacial tension forces. Where an element stands in a recess the communicating passage(s) in its side wall preferably extends to a level above the cell floor to avoid any possibility of clogging by slag.

Figure 2:
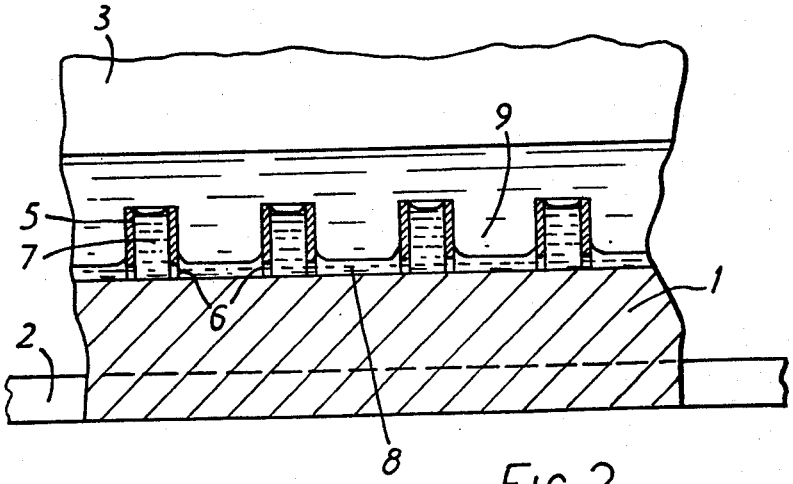
Figure 3:
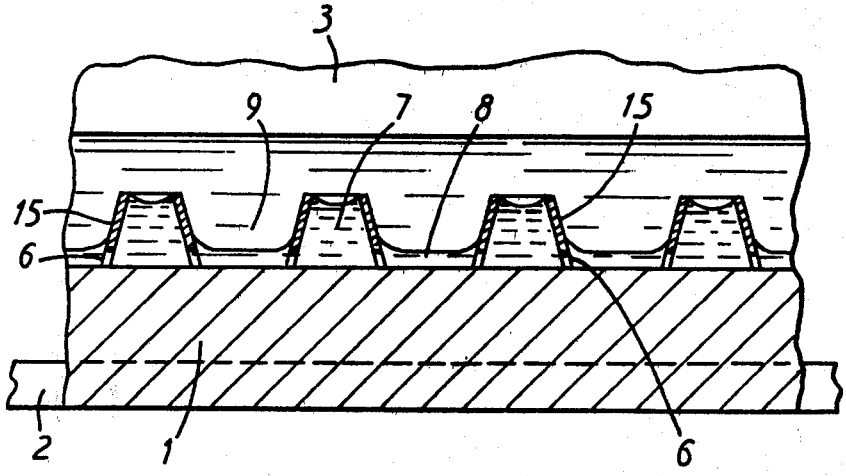

Referring to the accompanying drawings:

FIG. 1 is a diagrammatic perspective of the anode and cathode arrangement of an electrolytic reduction cell in accordance with the invention FIG. 2 is a partial diagrammatic section of the cell on a larger scale FIG. 3 is a partial diagrammatic section similar to FIG. 2 but employing a modified form of tubular element.

In FIG. 1 the cell electrolyte is enclosed with an outer steel shell, lined with a refractory lining (not shown). The cell has electrically conductive cathode floor blocks 1, in electrical connection with cathode collector bars 2, connected in known manner with cathode bus bars (not shown). The cell is provided with anodes 3, suspended by anode rods 4, supported in known manner for vertical movement.

On the floor are arranged a series of cylindrical tubular elements 5, constructed from a material which is wetted by molten aluminium but not by the cell electrolyte. The elements 5 are preferably maintained in substantially constant positions in relation to each other. Each element 5 is provided with a transverse slot 6 near its bottom end to permit free flow of molten metal from the metal 7 contained within the bore of the individual elements 5 to a shallow pool 8 of molten metal on the cell floor, as fresh metal is deposited at the cathode elements 5 by electrolytic action on the electrolyte 9.

In FIG. 2 the molten metal pool 8 is shown at a low level i.e. soon after tapping the cell. The vertical distance, h, between the surface of the pool 8 immediately after tapping and the tops of the elements 5 and the spacing between the elements 5 is selected at such value that the amount of molten metal produced between cell tappings increases the metal pool level by a distance smaller than h. In turn this requirement imposes a limitation on the diameter of the bore of the elements 5. Such bore diameter must be small enough to permit surface tension forces to maintain a column of molten metal in each element having a height equal to or greater than h.

In the modified construction of FIG. 3 the tubular elements 15 are externally conical and may have an internal conical or cylindrical bore. This arrangement allows for the height/base diameter ratio to be larger in relation to the volume of metal that can be accommodated between the elements at the same element spacing and thus improves the stability of the elements.

I claim:

1. An electrolytic reduction cell for the production of aluminium, comprising a floor (1), a pool of molten aluminium (8) on the floor, a layer of molten electrolyte (9) above the molten metal pool, one or more anodes (3)

dipping into the electrolyte layer and a cathode constituted by an array of upwardly open tubular elements (5) filled with molten aluminium and extending from the molten metal pool up into the electrolyte layer, characterized in that each tubular element is provided with a lateral opening (6) at its lower end whereby the molten metal in the tube is in open communication with that in the molten metal pool, the internal diameter of the tube being chosen so that the level of molten metal therein is maintained at or close to the upper end of the tube by capillary action at all molten metal levels occurring during normal operation of the cell, the material of the tubular element being preferentially wetted by the molten metal in the presence of the cell electrolyte.

2. A cell as claimed in claim 1, wherein the tubular elements are free-standing elements supported on the cell floor.

3. A cell as claimed in claim 1, wherein each tubular element has a tripod foot with lateral openings between the feet.

4. A cell as claimed in claim 1, wherein each tubular element has one or more vertical tubes therein open at their upper and lower ends.

5. A cell as claimed in claim 1, wherein, there is provided a monolayer of refractory hard metal elements submerged in the molten metal.

6. A cell as claimed in claim 1, wherein all cell surfaces exposed to molten aluminium and/or molten cell electrolyte are free of carbon or carbon-bearing materials to reduce the possibility of deposition of aluminium carbide in the tubular elements.

7. A cell as claimed in claim 1, wherein the tubular elements are of titanium diboride.

8. A cell as claimed in claim 1, wherein the length of the tubular elements is about 5 cm.

9. A cell as claimed in claim 1, wherein the diameter of the tubes is 0.5–2.5 cm.

10. A cell as claimed in claim 1, wherein the wall thickness of the tubular elements is 2–6 mm.

11. A cell as claimed in claim 1, wherein the inter-element spacing of the elements in the array is 1.2 to 3 times the external diameter of the tubular portion of the elements.

12. A cell as claimed in claim 1, wherein each tubular element is tapered from bottom to top.

13. A cell as claimed in claim 1, wherein the lower ends of the tubular elements are loosely fitted into shallow recesses in the cell floor.

14. A method of operating the cell claimed in claim 1, which method comprises passing an electric current between the cathode and the anode, whereby molten aluminium is formed and collects in a pool around the tubular elements, and periodically tapping off the molten aluminium, the frequency and extent of tapping being chosen with regard to the length of the tubular elements, so that the level of the molten aluminium before tapping is at least 1 cm below the top of the elements and the lateral openings remain submerged in molten aluminium after tapping.

* * * * *